US012292265B2

(12) United States Patent
Ji

(10) Patent No.: US 12,292,265 B2
(45) Date of Patent: May 6, 2025

(54) AUTOMATIC RESET TARGET

(71) Applicant: Shuqing Ji, Hebei (CN)

(72) Inventor: Shuqing Ji, Hebei (CN)

( * ) Notice: Subject to any disclaimer, the term of this patent is extended or adjusted under 35 U.S.C. 154(b) by 403 days.

(21) Appl. No.: 17/862,256

(22) Filed: Jul. 11, 2022

(65) Prior Publication Data

US 2024/0011748 A1 Jan. 11, 2024

(51) Int. Cl.
*F41J 1/10* (2006.01)
*F41J 7/00* (2006.01)

(52) U.S. Cl.
CPC .. *F41J 7/00* (2013.01); *F41J 1/10* (2013.01)

(58) Field of Classification Search
None
See application file for complete search history.

(56) References Cited

U.S. PATENT DOCUMENTS 4,588,194 A * 5/1986 Steidle ..... F41J 7/04 273/391
5,865,439 A * 2/1999 Marcuson, III ..... F41J 7/06 273/391
6,347,798 B1 * 2/2002 Quiring ..... F41J 7/04 273/391
7,052,012 B2 * 5/2006 Dehart ..... F41J 7/00 273/354
7,644,927 B2 * 1/2010 Law ..... F41J 1/10 40/607.1
10,088,279 B2 * 10/2018 Hoy, Jr. ..... F41J 5/18

* cited by examiner

*Primary Examiner* — Sunit Pandya

(57) ABSTRACT

The invention discloses an automatic reset target, comprising a gantry and shooting targets arranged on the gantry, the gantry is symmetrically provided with outriggers which are rotatably matched with it; the shooting targets include a large shooting target and small shooting targets, the small shooting targets are evenly arranged in multiples, which are rotatably matched with the gantry, and the large shooting target is rotatably matched with the gantry. Through the shooting targets' own gravity, the invention resets the shooting targets that are rotated and matched with the gantry, thereby realizing the advantageous effect of automatic reset. The invention has the advantages of simple and reasonable structure design, convenient use, unlimited installation position, simple manufacture, low cost and strong practicability.

3 Claims, 3 Drawing Sheets

AUTOMATIC RESET TARGET

1. TECHNICAL FIELD

The invention relates to the technical field of shooting targets, in particular to an automatic reset target.

2. BACKGROUND ART

Shooting practice is generally carried out in the shooting range, when the existing shooting targets are knocked down, some need to be reset manually, and some are automatically reset by the electric and manual method. Manual reset requires people to run to the target box to perform the reset operation, which has low reset efficiency and takes a long time.

Electric or pneumatic reset is relatively simple to operate, but additional power or other energy needs to be provided, the location of the shooting target is limited by power supply, and later maintenance costs are high, making it very inconvenient to use.

Therefore, an unrestricted self-resetting target still needs to be solved.

3. SUMMARY OF THE INVENTION

In order to solve the above technical problems, the invention provides the following technical scheme: an automatic reset target, comprising a gantry and shooting targets arranged on the gantry, the gantry is symmetrically provided with outriggers which are rotatably matched with it;

The shooting targets include a large shooting target and small shooting targets, the small shooting targets are evenly arranged in multiples, which are rotatably matched with the gantry, and the large shooting target is rotatably matched with the gantry.

As an improvement, the outrigger is a long rod, one end of which is vertically provided with a sleeve, sleeves are rotatably matched with the gantry, the gantry is provided with clamping teeth for restricting the sliding of sleeves, the inner ring of the lower end of the sleeve is provided with a clamping groove that cooperates with the clamping tooth, and the sleeve is fixedly connected to the gantry through the cooperation of the clamping tooth and the clamping groove.

As an improvement, the middle part of the gantry is horizontally provided with a cross bar, the small shooting target includes a small target rod and a small bull's-eye, one end of the small target rod is rotatably matched with the cross bar, and the other end is provided with a small bull's-eye fixedly connected with it, a plurality of small shooting targets are uniformly arranged along the length direction of the cross bar, and the cross bar is provided with protrusions that restrict the sliding of the small shooting targets.

As an improvement, the large shooting target includes a large target rod and a large bull's-eye, the middle part of the large target rod is rotatably matched with the gantry, one end of which is fixedly connected with the large bull's-eye, and the other end is vertically arranged with a long rod that is fixedly connected with it, the gantry is provided with the protrusion that restrict the sliding of the large shooting target.

After adopting the above structure, the invention has the following advantages: through the shooting targets' own gravity, the invention resets the shooting targets that are rotated and matched with the gantry, thereby realizing the advantageous effect of automatic reset. The invention has the advantages of simple and reasonable structure design, convenient use, unlimited installation position, simple manufacture, low cost and strong practicability.

4. BRIEF DESCRIPTION OF ACCOMPANY DRAWINGS

As shown in the accompanying drawings: 1 gantry, 1.1 cross bar, 2 outriggers, 2.1 sleeves, 2.11 clamping grooves, 3 large shooting target, 3.1 large target rod, 3.2 large bull's-eye, 3.3 long rod, 4 small shooting targets, 4.1 small target rods, 4.2 small bull's-eyes, 5 clamping teeth.

5. SPECIFIC EMBODIMENT OF THE INVENTION

Figure 1:
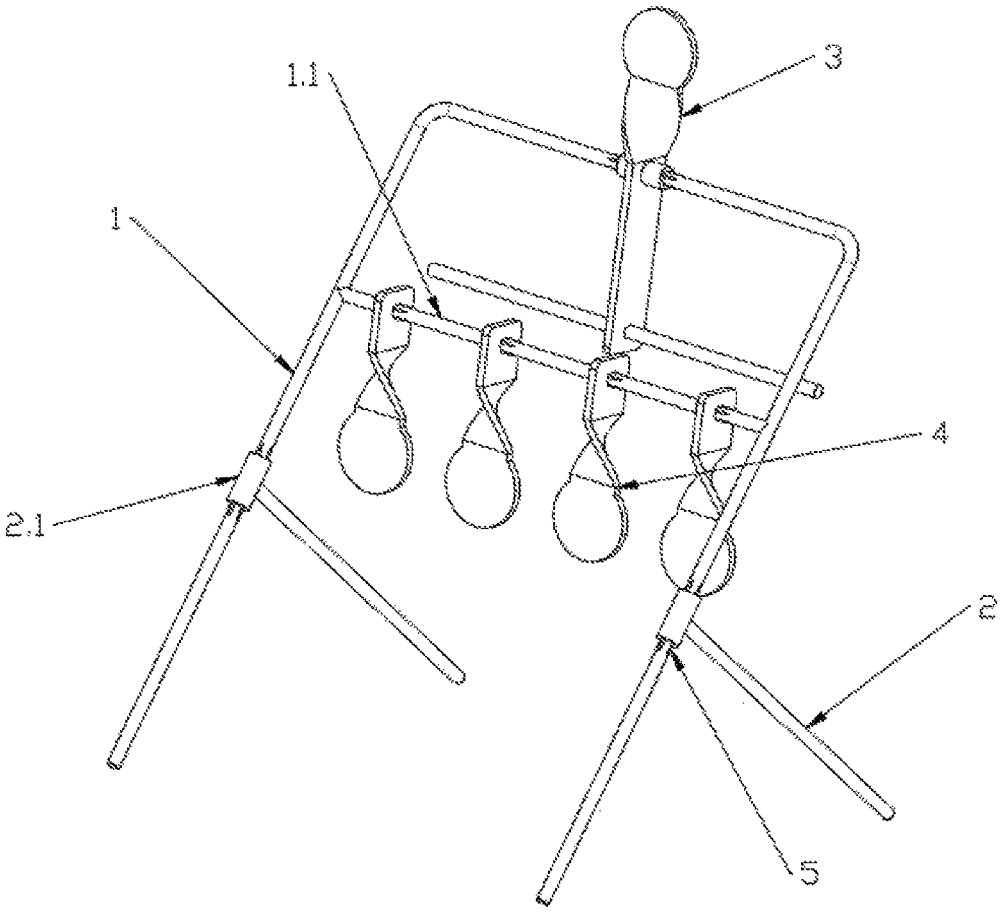
FIG. 1 is the schematic diagram of an automatic reset target of the invention.
Figure 2:
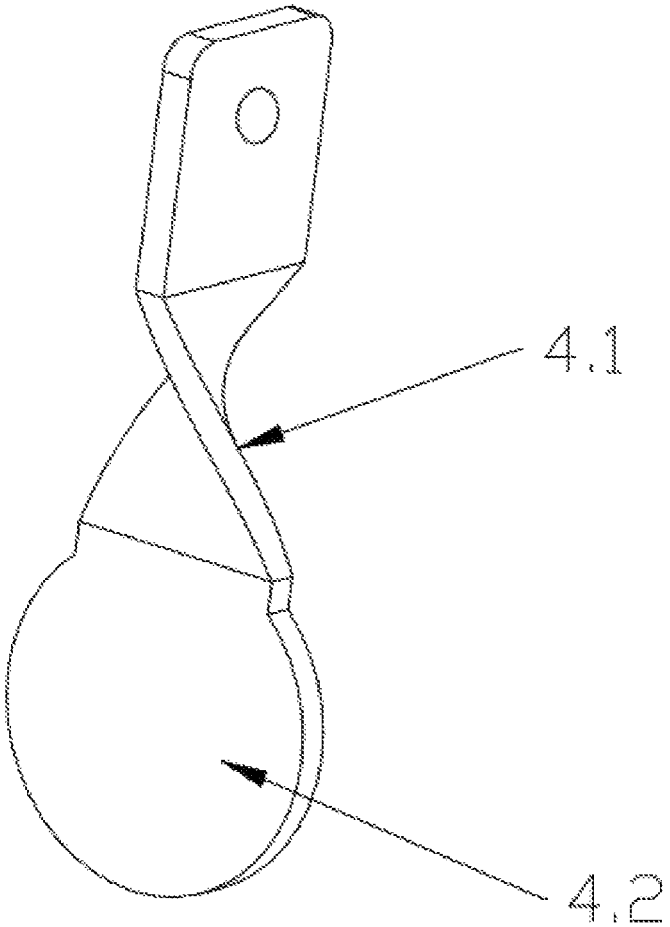
FIG. 2 is the schematic diagram of the small shooting target of an automatic reset target of the invention.
Figure 3:
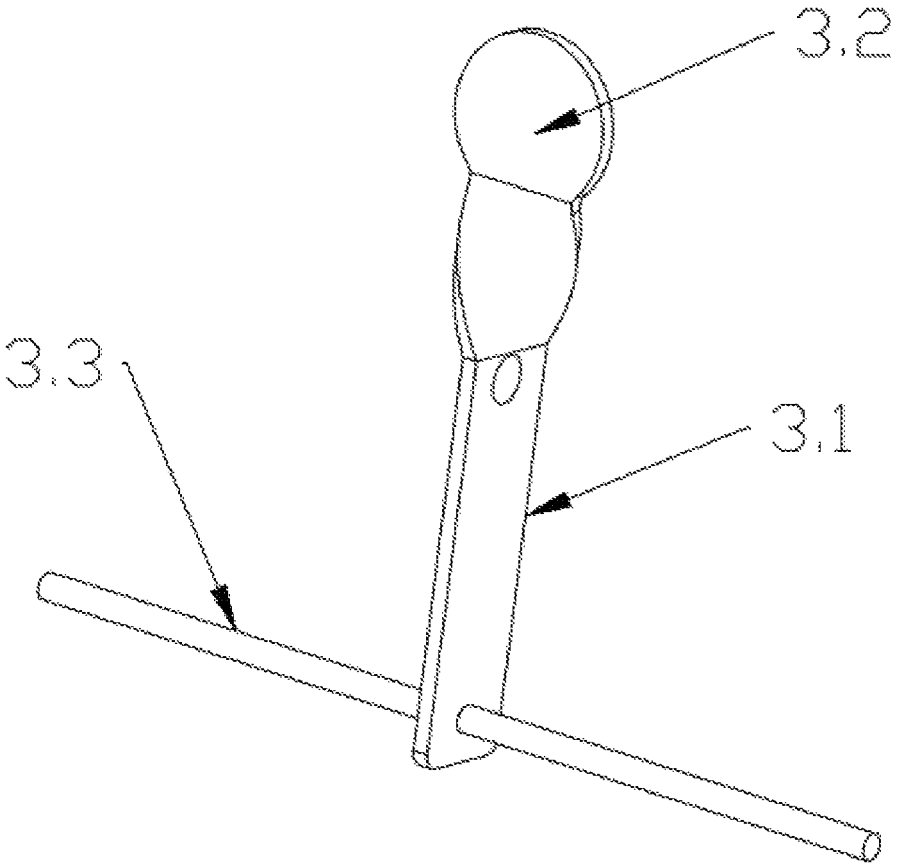
FIG. 3 is the schematic diagram of the large shooting target of an automatic reset target of the invention.
Figure 4:
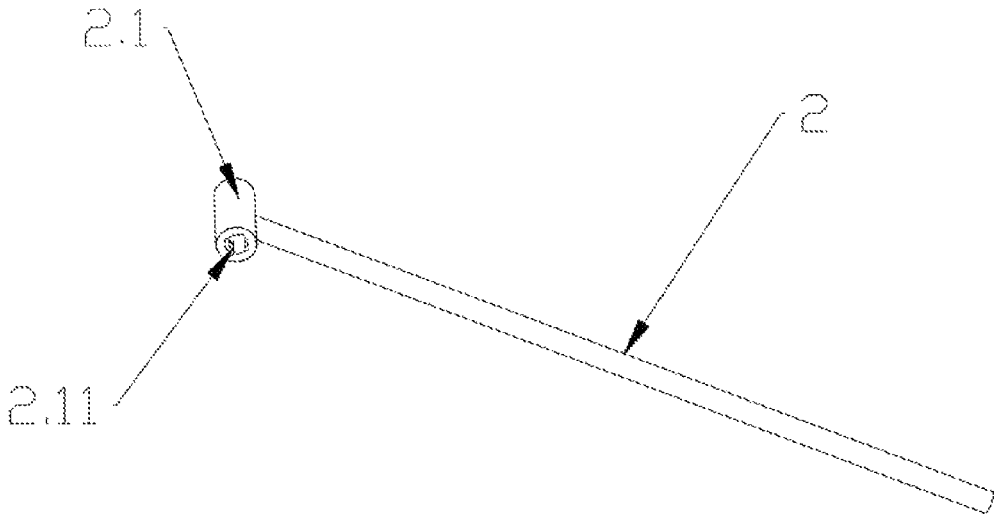
FIG. 4 is the schematic diagram of the outrigger of the large shooting target of an automatic reset target of the invention.

Combined with FIG. 1-4, an automatic reset target, comprising a gantry 1 and shooting targets arranged on the gantry 1, the gantry 1 is symmetrically provided with outriggers 2 which are rotatably matched with it;

The shooting targets include a large shooting target 3 and small shooting targets 4, the small shooting targets 4 are evenly arranged in multiples, which are rotatably matched with the gantry 1, and the large shooting target 3 is rotatably matched with the gantry 1.

Preferably, the outrigger 2 is a long rod, one end of which is vertically provided with a sleeve 2.1, sleeves 2.1 are rotatably matched with the gantry 1, the gantry 1 is provided with clamping teeth 5 for restricting the sliding of sleeves 2.1, the inner ring of the lower end of the sleeve 2.1 is provided with a clamping groove 2.11 that cooperates with the clamping tooth 5, and the sleeve 2.1 is fixedly connected to the gantry 1 through the cooperation of the clamping tooth 5 and the clamping groove 2.11.

Preferably, the middle part of the gantry 1 is horizontally provided with a cross bar 1.1, the small shooting target 4 includes a small target rod 4.1 and a small bull's-eye 4.2, one end of the small target rod 4.1 is rotatably matched with the cross bar 1.1, and the other end is provided with a small bull's-eye 4.2 fixedly connected with it, a plurality of small shooting targets 4 are uniformly arranged along the length direction of the cross bar 1.1, and the cross bar 1.1 is provided with protrusions that restrict the sliding of the small shooting targets 4.

Preferably, the large shooting target 3 includes a large target rod 3.1 and a large bull's-eye 3.2, the middle part of the large target rod 3.1 is rotatably matched with the gantry 1, one end of which is fixedly connected with the large bull's-eye 3.2, and the other end is vertically arranged with a long rod 3.3 that is fixedly connected with it, the gantry 1 is provided with the protrusion that restrict the sliding of the large shooting target 3. The long rod is set parallel to the cross bar.

In the description of the invention, it should be understood that the orientation or positional relationship indicated by the terms "upper", "lower", "left", "right" and so on are based on the orientation or positional relationship shown in the accompanying drawings, only for the convenience of describing the invention and simplifying the description, rather than indicating or implying that the indicated device or element must have a specific orientation, as well as a specific orientation structure and operation, therefore, it should not be construed as a limitation of the invention. In addition, the terms of "first" and "second" are only used for descriptive purposes, and should not be construed as indicating or implying relative importance or implying the number of indicated technical features. Therefore, the features defined with "first" and "second" may expressly or implicitly include one or more of the features, and in the description of the invention, the meaning of "multiple" is two or two above, unless otherwise expressly specifically defined.

In the invention, the terms of "arrange", "link", "connect" and "fix" etc., should be generally understood unless there are specific restrictions or stipulations, for example, the "connect" may refer to fixed connection, detachable connection or integral connection; the "connect" may also refer to mechanical connection or electrical connection; the means of "connect" may be directly connected or indirectly connected through an intermediate medium, and may be internal communication between the two elements. For those skilled in the art, the specific meaning of the above terms in the invention can be understood according to the specific situation.

The invention and its embodiments have been described above, and this description is not restrictive, what is shown in the accompanying drawings is only one of the embodiments of the invention, and the actual structure is not limited to this. All in all, if those of ordinary skill in the art are inspired by it, without departing from the purpose of creation of the invention, without creatively designing structural modes and embodiments similar to the technical scheme, all should belong to the protection scope of the invention.

The invention claimed is:

1. An automatic reset target, comprising a gantry and shooting targets arranged on the gantry, the gantry is symmetrically provided with outriggers which are rotatably matched with it;

the shooting targets include a large shooting target and small shooting targets, the small shooting targets are evenly arranged in multiples, which are rotatably matched with the gantry, and the large shooting target is rotatably matched with the gantry;

the outrigger is a long rod, one end of which is vertically provided with a sleeve, sleeves are rotatably matched with the gantry, the gantry is provided with clamping teeth for restricting the sliding of sleeves, the inner ring of the lower end of the sleeve is provided with a clamping groove that cooperates with the clamping tooth, and the sleeve is fixedly connected to the gantry through the cooperation of the clamping tooth and the clamping groove.

2. An automatic reset target of claim 1, the middle part of the gantry is horizontally provided with a cross bar, the small shooting target includes a small target rod and a small bull's-eye, one end of the small target rod is rotatably matched with the cross bar, and the other end is provided with a small bull's-eye fixedly connected with it, a plurality of small shooting targets are uniformly arranged along the length direction of the cross bar, and the cross bar is provided with protrusions that restrict the sliding of the small shooting targets.

3. An automatic reset target of claim 1, the large shooting target includes a large target rod and a large bull's-eye, the middle part of the large target rod is rotatably matched with the gantry, one end of which is fixedly connected with the large bull's-eye, and the other end is vertically arranged with a long rod that is fixedly connected with it, the gantry is provided with the protrusion that restrict the sliding of the large shooting target.

* * * * *